US008651567B2

(12) United States Patent
Aldred

(10) Patent No.: US 8,651,567 B2
(45) Date of Patent: Feb. 18, 2014

(54) FOLDING CHAIR

(75) Inventor: Darren Aldred, Morristown, TN (US)

(73) Assignee: Meco Corporation, Greeneville, TN (US)

( * ) Notice: Subject to any disclaimer, the term of this patent is extended or adjusted under 35 U.S.C. 154(b) by 29 days.

(21) Appl. No.: 13/492,216

(22) Filed: Jun. 8, 2012

(65) Prior Publication Data

US 2012/0313402 A1 Dec. 13, 2012

Related U.S. Application Data

(60) Provisional application No. 61/495,058, filed on Jun. 9, 2011.

(51) Int. Cl.
*A47C 4/00* (2006.01)
*A47C 4/04* (2006.01)

(52) U.S. Cl.
USPC ..... 297/59; 297/60

(58) Field of Classification Search
USPC ..... 297/59, 60
See application file for complete search history.

(56) References Cited

U.S. PATENT DOCUMENTS

| | | | | | |
|---|---|---|---|---|---|
| 1,926,840 | A * | 9/1933 | Dick | 297/59 |
| 1,970,266 | A * | 8/1934 | Allerding | 297/60 |
| 1,988,811 | A * | 1/1935 | Salomon | 297/60 |
| 2,044,473 | A * | 6/1936 | Geller | 297/59 |
| 2,098,711 | A * | 11/1937 | Rastetter | 297/59 |
| 2,697,481 | A * | 12/1954 | Zoercher | 297/60 |
| 3,030,141 | A * | 4/1962 | Geller | 297/60 |
| 3,236,558 | A * | 2/1966 | Kaufman | 297/59 |
| 5,624,153 | A * | 4/1997 | Censullo, Jr. | 297/59 |
| D464,493 | S * | 10/2002 | Stannard | D6/368 |
| D465,664 | S * | 11/2002 | Stannard | D6/368 |
| 6,540,290 | B2 * | 4/2003 | Liu | 297/59 X |
| 7,954,890 | B2 * | 6/2011 | Wright | 297/59 X |
| D653,470 | S * | 2/2012 | Niermeyer | D6/368 |
| 2008/0238157 | A1 * | 10/2008 | Wright et al. | 297/59 |
| 2009/0179464 | A1 * | 7/2009 | Wright | 297/59 |

* cited by examiner

*Primary Examiner* — Rodney B White
(74) *Attorney, Agent, or Firm* — McGuire Woods, LLP

(57) ABSTRACT

A folding chair is disclosed that meets and/or exceeds, for example, ANSI/BIFMA standards. The folding chair may be made from a material that includes, metal, wood, plastic, or the like. Independent of the particular material used in the folding chair, the disclosed folding chair includes a configuration that satisfies, or surpasses, for example, ANSI/BIFMA leg strength testing, among other tests.

14 Claims, 7 Drawing Sheets

FOLDING CHAIR

CROSS REFERENCE TO PRIOR APPLICATION

This application claims priority to and the benefit thereof from U.S. Provisional Patent Application No. 61/495,058, filed on Jun. 9, 2011, titled "Folding Chair," the entirety of which is hereby incorporated herein by reference.

BACKGROUND OF THE DISCLOSURE

1. Field of the Disclosure

The present disclosure relates to a folding chair, which may be made from metal, wood, synthetic materials, or the like.

2. Related Art

A variety of types, styles, and sizes of folding chairs are currently available. Manufacturers of folding chairs look to the American National Standards Institute (ANSI) and the Business and Institutional Furniture Manufacturer's Association (BIFMA) to identify applicable standards, which define specific tests, laboratory equipment to be used, test conditions, and minimum acceptable levels to be used in evaluating products. In particular, ANSI/BIFMA safety and performance standards are developed by the BIFMA Engineering Committee. These standards are intended to provide manufacturers and users with a common basis for evaluating safety, durability, and structural adequacy of the furniture. A need exists for a folding chair that complies with the ANSI/BIFMA standards and which is easy to manipulate and use.

The disclosure provides a folding chair that is easy to manipulate and use, and which is safe and durable.

SUMMARY OF THE DISCLOSURE

According to a non-limiting example of the disclosure, a folding chair is disclosed that is easy to manipulate and use, and that is safe and durable. The folding chair may be made from a material that includes, metal, wood, plastic, or the like. Independent of the particular material used in the folding chair, the disclosed folding chair includes a configuration that satisfies, or surpasses, for example, ANSI/BIFMA leg strength testing, among other tests.

In one aspect, a folding chair is provided that includes a first subassembly comprising a first set of brace elements connected to a second subassembly comprising a second set of brace elements, each set of brace elements having a first brace element, a second brace element and a third brace element, each brace element having a first end and a second end, a cross-brace rigidly connecting the first brace element of the first subassembly with the first brace element of the second subassembly, the first subassembly and second subassembly being spaced apart from one another, a pair of front legs with a front cross-brace connected therebetween, and a pair of rear legs and a frame configured to receive a seat, and connected to each of the legs, wherein the first end of each first brace element rotatably connects to the front cross-brace, and the second end of each first brace element rotatably connects with a second brace element of a same subassembly, and wherein a first end of each second brace element rotatably connects to the frame and the second end of each second brace element rotatably connects to a respective one of the pair of rear legs, and wherein a first end of each third brace element rotatably connects to a respective one of the pair of rear legs and a second end of each third cross-brace element rotatably connects to the first brace element of a same subassembly, and wherein the first subassembly and second subassembly are configured to expand or collapse thereby permitting the folding chair to expand to an open position or collapse to a closed position.

In one aspect, a folding chair is provided that includes a first subassembly comprising a first set of brace elements connected to a second subassembly comprising a second set of brace elements, each set of brace elements having a first brace element, a second brace element and a third brace element, each brace element having a first end and a second end, a cross-brace rigidly connecting the first brace element of the first subassembly with the first brace element of the second subassembly, the first subassembly and second subassembly being spaced apart from one another, wherein the cross-brace maintains alignment of the first and second subassemblies in relation to one another, and resists twisting and binding of the subassemblies, a pair of front legs with a front cross-brace connected therebetween, and a pair of rear legs, and a frame configured to receive a seat, and connected to each of the legs, wherein the first end of each first brace element rotatably connects to the front cross-brace at a point spaced apart from a nearest leg, and the second end of each first brace element rotatably connects with a second brace element of a same subassembly, and wherein a first end of each second brace element rotatably connects to the frame and the second end of each second brace element rotatably connects to a respective one of the pair of rear legs, and wherein a first end of each third brace element rotatably connects to a respective one of the pair of rear legs and a second end of each third cross-brace element rotatably connects to the first brace element of a same subassembly, and wherein the first subassembly and second subassembly are configured to expand or collapse thereby permitting the folding chair to expand to an open position or collapse to a closed position.

Additional features, advantages, and embodiments of the disclosure may be set forth or apparent from consideration of the detailed description and drawings. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

Figure 1:
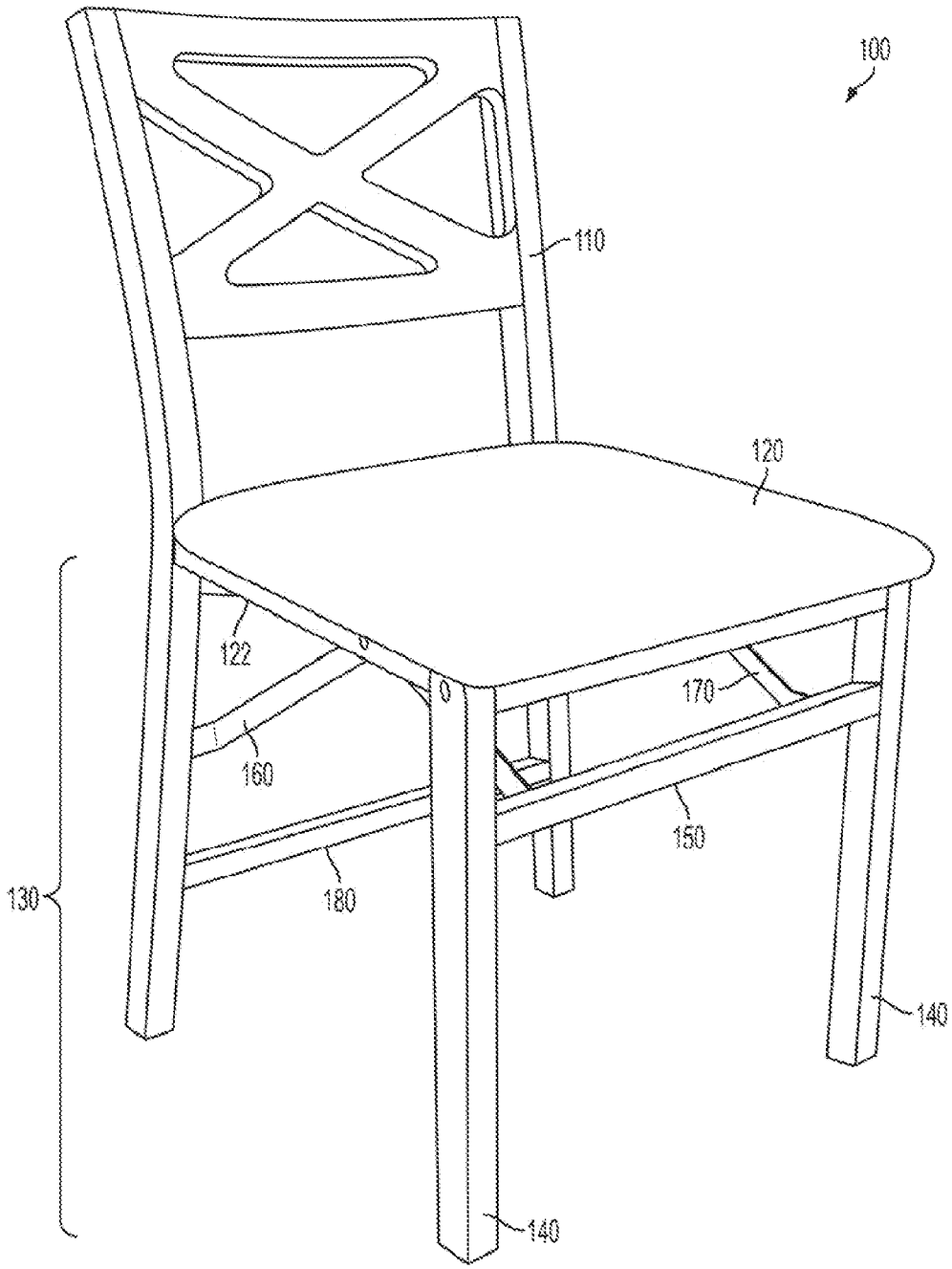
FIG. 1 shows a perspective view of an example of a folding chair, constructed according to principles of the disclosure.

The present disclosure is further described in the detailed description that follows.

DETAILED DESCRIPTION OF THE DISCLOSURE

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

FIG. 1 shows an example of a folding chair 100, which is constructed according to the principles of the disclosure. The chair 100 includes a back support 110, a seat 120 having a frame 122, and a leg assembly 130. The leg assembly 130 includes a plurality of legs 140, a front cross-brace 150, a scissor subassembly 160, 170, and rear cross-brace 180.

Figure 2:
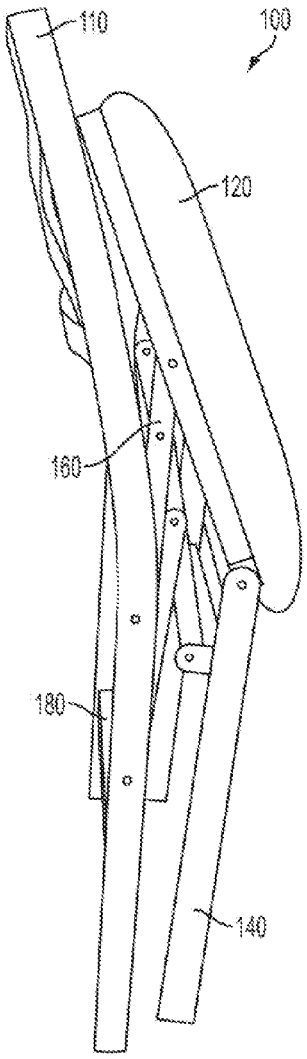
FIG. 2 shows a side view of the folding chair of FIG. 1 in a substantially collapsed (or folded) configuration.
Figure 3:
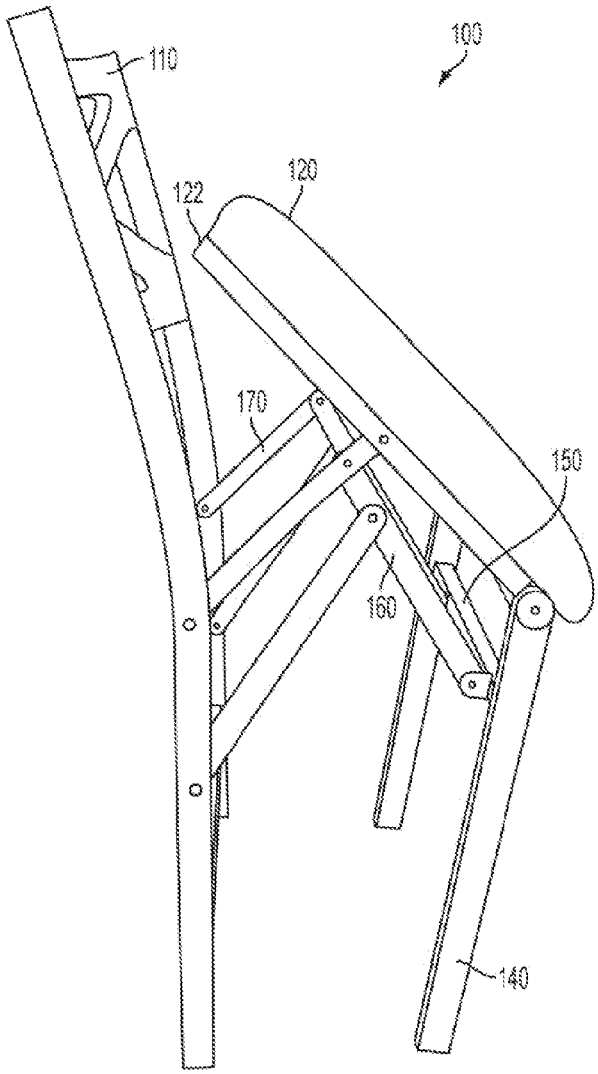
FIG. 3 shows a side view of the folding chair of FIG. 1 in a partially collapsed (or folded) configuration.
Figure 4:
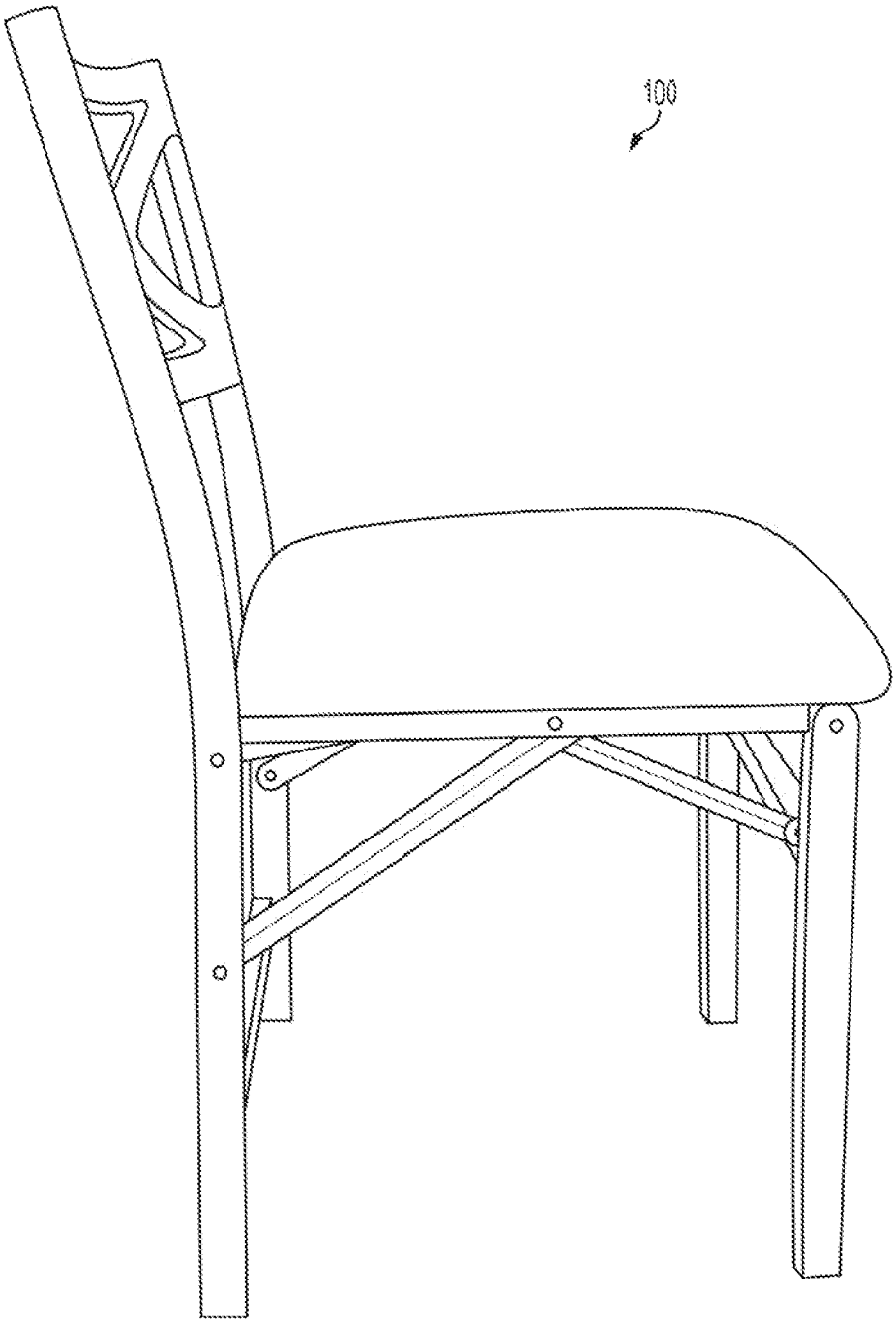
FIG. 4 shows a side view of the folding chair of FIG. 1 in a substantially open (or unfolded) configuration.

FIGS. 2-7 show various views of the folding chair 100. In particular, FIG. 2 shows a side view of the folding chair 100 in a substantially collapsed (or folded) configuration such as for transport or storage; FIG. 3 shows a side view of the folding chair 100 in a partially collapsed (or folded) configuration. As shown, when collapsing the folding chair 100, the seat 120 may rotate to extend the back part of the seat 120 upwardly to align the seat vertically with a back rest of the chair, while the front legs 140 move towards the rear legs to compress the overall profile of the chair. FIG. 4 shows a side view of the folding chair 100 in a substantially open (or unfolded) configuration, which may be a typical configuration for use by a person to sit in the chair.

Figure 5:
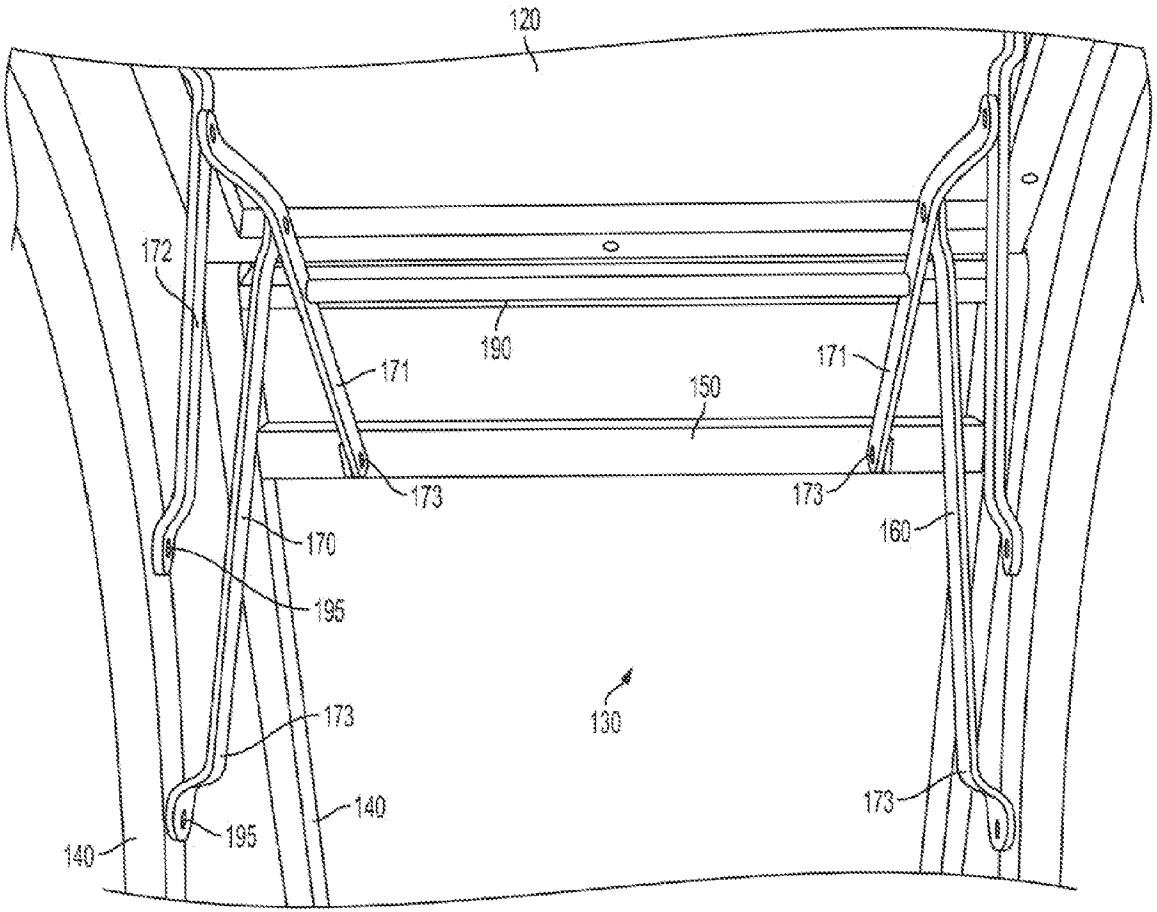
FIG. 5 shows a detailed view of an example of a leg assembly that may be included in the folding chair of FIG. 1.

FIG. 5 shows a detailed view of the leg assembly 130 that may be included in the folding chair 100. The leg assembly 130 may comprise a front cross-brace 150 positioned between and connected to two front legs 140. Two spaced-apart scissor subassemblies 160, 170 may be affixed at one end to the cross-brace 150. Each subassembly 160, 170 may be configured with a first brace element 171 that may be rotatably affixed to the cross-brace 150. Each subassembly 160, 170 may be configured with second brace element 172 that may rotatably connect with a corresponding rear leg 140 at one end and also may rotatably connect with the frame 122 of the seat 120 at the other end. The location of the connection to the frame 122 by the second brace element 172 may be about the midpoint between the front leg 140 and rear leg 140. The second brace element 172 may also rotatably connect with an end of the first brace element 171 at a location of the second brace element 172 proximate where the second brace element 172 connects with the frame 122. Each subassembly 160, 170 may also be configured with a third brace element 173 that may rotatably connect at a first end with a corresponding rear leg 140 at a point beneath where the second brace element 172 connects with the rear leg 140. Moreover, the other end of the third brace element 173 may connect with the first brace element 171. A brace 190 (or cross-brace) may be rigidly connected between the pair of first brace elements 171, the point of connection of the brace 190 with first brace element 171 may be proximate where the third brace element 173 may connect with the first brace element 171. The configuration of the scissor subassemblies 160, 170 is discussed in more detail in connection with FIG. 8 below. The brace 190 is shown as a tubular brace, however, other geometries are possible.

Figure 6:
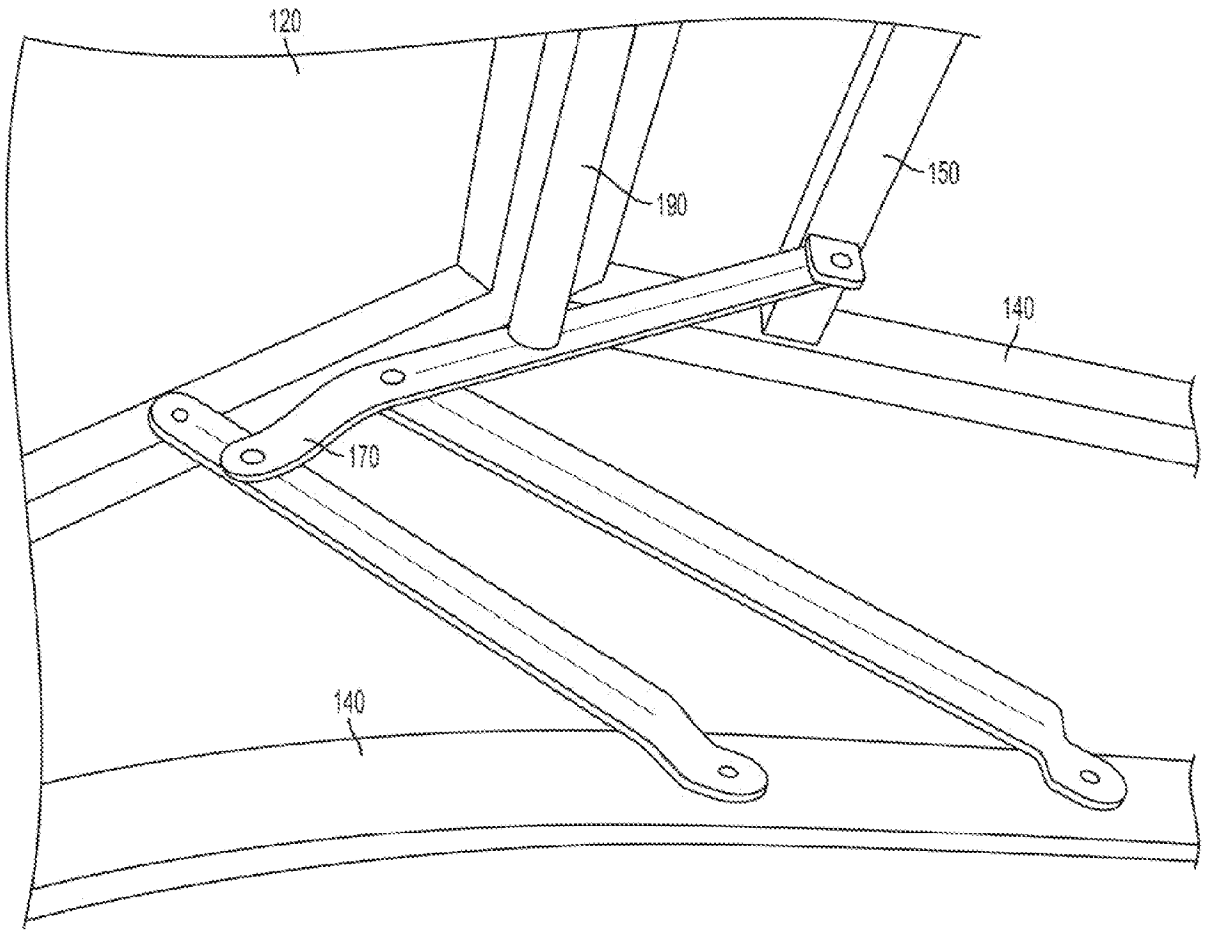
FIG. 6 shows a partial view of the leg assembly of FIG. 5.
Figure 7:
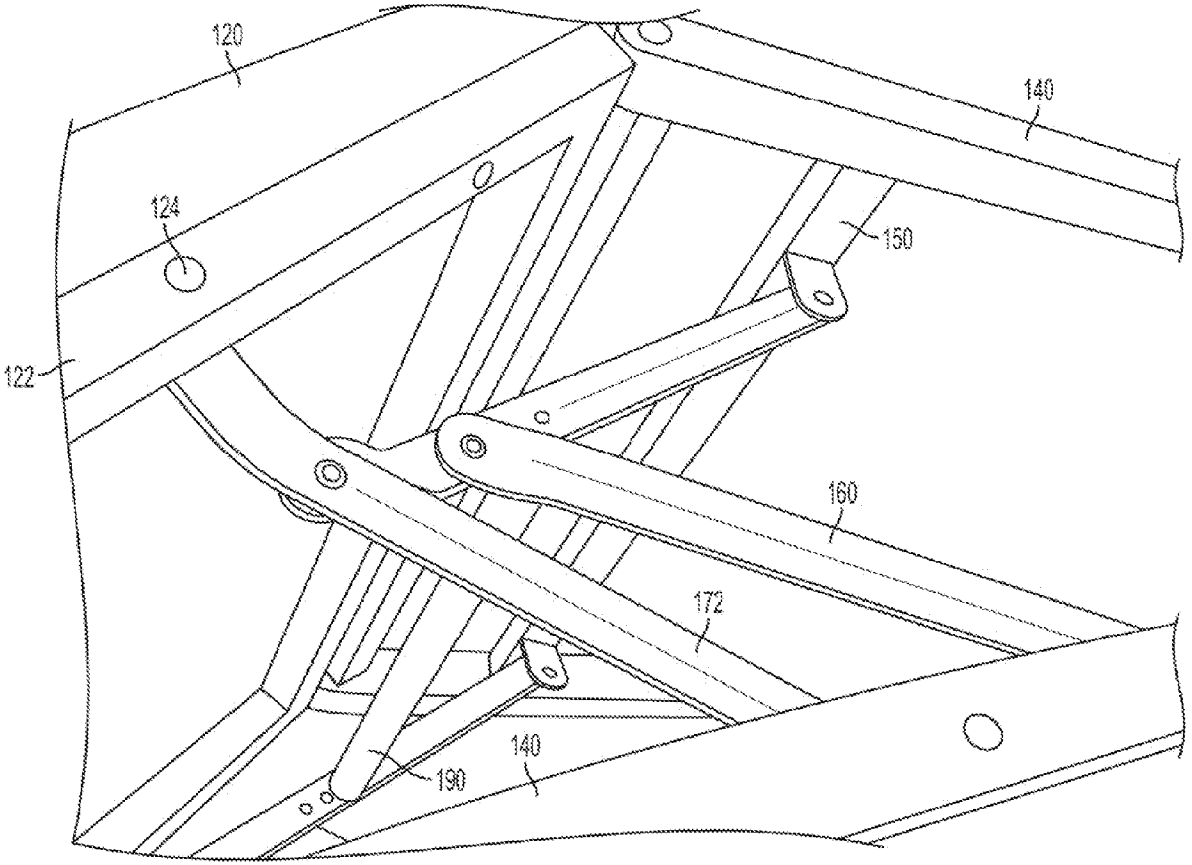
FIG. 7 shows another partial view of the leg assembly of FIG. 5.

FIG. 6 shows a partial view of the leg assembly 130; and FIG. 7 shows another partial view of the leg assembly 130.

Figure 8:
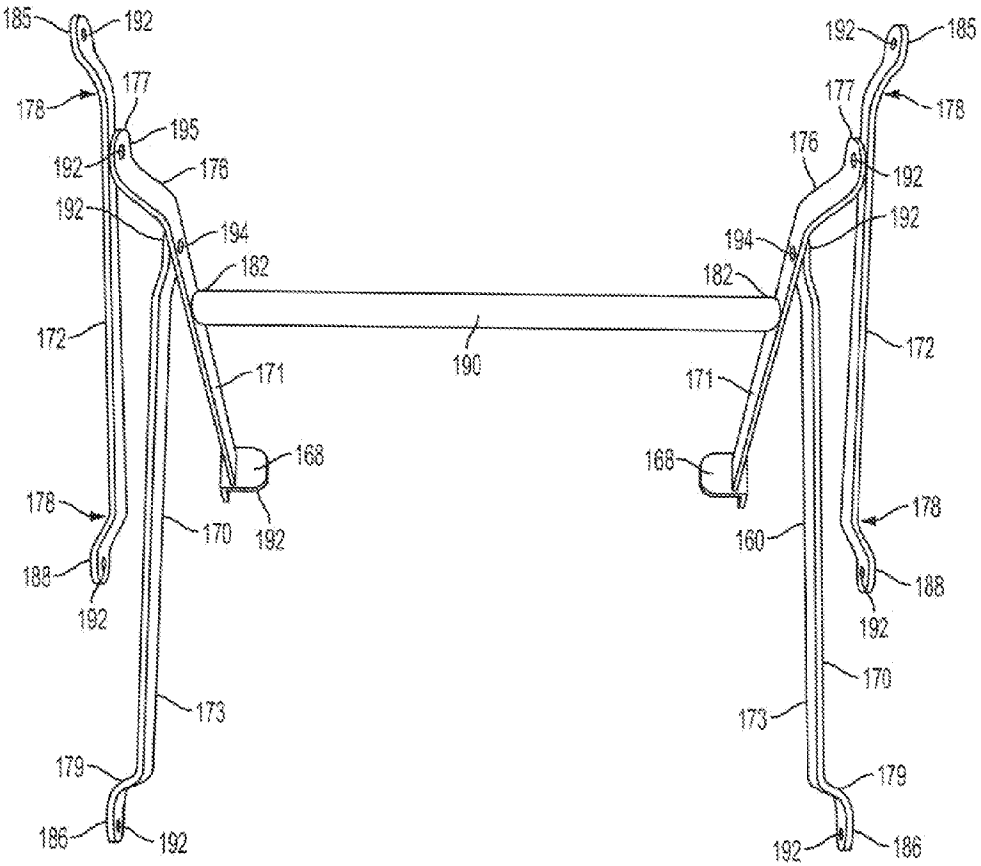
FIG. 8 shows an example of a scissor assembly that may be included in the leg assembly of FIG. 5 and the folding chair of FIG. 1.

FIG. 8 shows an example of the scissor subassembly 160, 170, which may be included in the leg assembly 130. As shown previously in relation to FIG. 5, the scissor subassembly 160, 170 may be affixed at one end to the cross brace 150 and/or the front legs 140. At the other end, the scissor subassembly 160, 170 may be pivotally affixed to the rear legs 140. The scissor subassembly 160, 170 is configured to collapse (or fold) and/or expand, such as under guidance of a person, for storage or use. The scissor subassembly 160, 170 may be rigidly attached to respective ends of a brace 190, which provide substantial added strength to scissor subassembly 160, 170 and the leg assembly 130. The brace 190 provides considerable strength and mutual stability to the scissor subassembly 160, 170, and thus the chair overall. The brace 190 between the scissor subassemblies 160, 170 provides added substantial major strength to the whole folding chair 100 overall such that the folding chair configuration satisfies or surpasses ANSI/BIFMA safety and performance standards for example, ANSI/BIFMA leg strength testing, among other tests. The addition of the brace 90 between the scissor subassemblies 160, 170 is a significant contribution to the overall performance (e.g., stability, strength, operational functioning, and the like) of the folding chair. In some versions, the brace 90 may be attached at a different location along the scissor subassemblies 160, 170. Moreover, a second brace 90 may also be possible between the scissor subassemblies 160, 170.

The two subassemblies 160, 170 may substantially mirror one another in configuration. Each subassembly 160, 170 may be configured with a first brace element 171 having a first end 168 rotatably connectable to a cross-brace 150 (FIG. 5). A second end 177 of the first brace element 171 may be configured to rotatably connect with a second brace element 172 and also configured to rotatably connect with the third extension brace element 173. The first brace element 171 may be configured with a bend 176 proximate the second end 177 so that the second end 177 is extended outwardly from the first brace element 171 to create a laterally spacing to permit the second brace element 172 and the third brace element 173 to freely move without undue interference when the subassemblies 160, 170 are expanded or collapsed.

The second brace element 172 may be configured to rotatably connect with a frame 122 (FIG. 1) at a first end 185. The point of connection 124 to the frame may be about mid-way between the front and back legs 140, or at a point at a mid-section between the front and back legs 140. The second brace element 172 may be configured to rotatably connect to a rear leg 140 at a second end 188. The second end 188 may connect to the rear leg 140 at a point located above a point where the third brace element 173 may connect with the rear leg 140. The second brace element 172 may be configured with a bend 178 proximate each end 185, 188 so that both ends 185, 188 extend outwardly from the body of the second brace element 172 to permit free movement without undue interference when the subassemblies 160, 170 are expanded or collapsed, and also to permit cooperative alignment among the various braces 171, 172, 173 with the frame 122 and legs 140 when in a collapsed state.

The third brace element 173 may rotatably connect at a first end 186 with a rear leg 140, at a point beneath where the second brace element 172 connects to the rear leg 140. A bend 179 proximate first end 186 permits lateral spacing for allowing the second brace element 172 to move freely without interference in relation to the third brace element 173 during expansion or collapsing of the subassemblies 160, 170. A second end 194 of the third brace element may rotatably connect to the first brace element 171 at a location that is located between the bend 179 and a point where brace 190 connects to the first brace element 171.

The rotatable connections herein may be accomplished, for example, by a fastener such as a rivet 195 through hole 192, although other techniques are possible. The first end 168 of the first brace element 171 may be permanently affixed to the front cross-brace 150 such as by welding, for example, but still configured to permit the first brace element to rotate.

The brace 190 is configured to maintain stability of the subassemblies 160, 170 and thus the folding chair 100 by strengthening the support structure overall such as, for example, aiding in resisting lateral forces which may be caused by lateral motion of a person sitting in the chair 100. The brace 190 also may assist in equalizing forces applied by a user during expanding or collapsing the folding chair 100 by equalizing forces to one subassemblies 160, 170 to the other subassembly 160, 170. The subassemblies 160, 170 may remain better aligned during the expanding or collapsing because of the brace 190, thereby assisting to minimize binding or twisting action of the chair support structure. The configuration of the brace 190 and subassemblies 160, 170 may provide for a single mechanism which not only provides substantial support structure to the folding chair 100, but also permits both assemblies 160, 170 to automatically cooperate with one another as a single unit during folding or expansion of the folding chair 100.

The folding chair 100 may include any known fastening means, such as, for example, but not limited to, screws, bolts, nuts, clamps, clips, pins, welds, rivets, or the like, to position and secure the various components of the folding chair 100 as shown in the drawings and described herein. According to the preferred embodiment, the leg assembly 130, including the legs 140, cross brace 150, scissor subassembly 160, 170, and brace 190 may be made of a metal, such as, for example, steel, aluminum, or the like. According to alternative embodiments of the disclosure, the components of the folding chair 100, including the leg assembly 130 may be made using materials other than metal, such as, for example, plastic, wood, carbon fiber, synthetic materials, or the like.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

What is claimed:

1. A folding chair, comprising:

a first subassembly comprising a first set of brace elements connected to a second subassembly comprising a second set of brace elements, each set of brace elements having a first brace element, a second brace element and a third brace element, each brace element having a first end and a second end;

a cross-brace rigidly connecting the first brace element of the first subassembly with the first brace element of the second subassembly, the first subassembly and second subassembly being spaced apart from one another, wherein for each subassembly, the first brace element is positioned interior of the second brace element and the third brace element of a same subassembly;

a pair of front legs with a front cross-brace connected therebetween, and a pair of rear legs; and a frame configured to receive a seat, and connected to each of the legs, wherein the first end of each first brace element rotatably connects to the front cross-brace, and the second end of each first brace element rotatably connects with a second brace element of a same subassembly, and wherein a first end of each second brace element rotatably connects to the frame and the second end of each second brace element rotatably connects to a respective one of the pair of rear legs, and wherein a first end of each third brace element rotatably connects to a respective one of the pair of rear legs and a second end of each third cross-brace element rotatably connects to the first brace element of a same subassembly, and wherein the first subassembly and second subassembly are configured to expand or collapse thereby permitting the folding chair to expand to an open position or collapse to a closed position.

2. The folding chair of claim 1, wherein the cross-brace maintains alignment of the first and second subassemblies in relation to one another, and resists twisting and binding of the subassemblies.

3. The folding chair of claim 1, wherein the first end of each third brace element rotatably connects to a respective one of the pair of rear legs at a point lower than a point where the second end of each second brace element rotatably connects to the same respective one of the pair of rear legs.

4. The folding chair of claim 1, wherein the cross-brace connects to each subassembly at a same corresponding point of each respective first brace element, and the second end of each third brace element rotatably connects to the first brace element of the same subassembly at a point between (a) the corresponding point and (b) a location where the first brace element rotatably connects with the second brace element of the same subassembly.

5. A folding chair, comprising:

a first subassembly comprising a first set of brace elements connected to a second subassembly comprising a second set of brace elements, each set of brace elements having a first brace element, a second brace element and a third brace element, each brace element having a first end and a second end;

a cross-brace rigidly connecting the first brace element of the first subassembly with the first brace element of the second subassembly, the first subassembly and second subassembly being spaced apart from one another, a pair of front legs with a front cross-brace connected therebetween, and a pair of rear legs; and a frame configured to receive a seat, and connected to each of the legs, wherein the first end of each first brace element rotatably connects to the front cross-brace, and the second end of each first brace element rotatably connects with a second brace element of a same subassembly, and wherein a first end of each second brace element rotatably connects to the frame and the second end of each second brace element rotatably connects to a respective one of the pair of rear legs, and wherein a first end of each third brace element rotatably connects to a respective one of the pair of rear legs and a second end of each third cross-brace element rotatably connects to the first brace element of a same subassembly, and wherein the first subassembly and second subassembly are configured to expand or collapse thereby permitting the folding chair to expand to an open position or collapse to a closed position;

wherein the cross-brace connects to each subassembly at a same corresponding point of each respective first brace element, and the second end of each third brace element rotatably connects to the first brace element of the same subassembly at a point between (a) the corresponding point and (b) a bend proximate the second end of the first brace element.

6. A folding chair, comprising:

a first subassembly comprising a first set of brace elements connected to a second subassembly comprising a second set of brace elements, each set of brace elements having a first brace element, a second brace element and a third brace element, each brace element having a first end and a second end;

a cross-brace rigidly connecting the first brace element of the first subassembly with the first brace element of the second subassembly, the first subassembly and second subassembly being spaced apart from one another, a pair of front legs with a front cross-brace connected therebetween, and a pair of rear legs; and a frame configured to receive a seat, and connected to each of the legs, wherein the first end of each first brace element rotatably connects to the front cross-brace, and the second end of each first brace element rotatably connects with a second brace element of a same subassembly, and wherein a first end of each second brace element rotatably connects to the frame and the second end of each second brace element rotatably connects to a respective one of the pair of rear legs, and wherein a first end of each third brace element rotatably connects to a respective one of the pair of rear legs and a second end of each third cross-brace element rotatably connects to the first brace element of a same subassembly, and wherein the first subassembly and second subassembly are configured to expand or collapse thereby permitting the folding chair to expand to an open position or collapse to a closed position;

wherein a bend is formed proximate each first end of each second brace element and a second bend is formed proximate each second end of each second brace element.

7. The folding chair of claim 6, wherein a bend is formed proximate the first end of each third brace element that rotatably connects to a respective one of the pair of rear legs.

8. The folding chair of claim 1, wherein each third brace element and each second brace element are each configured to fold so that each third brace element and each second brace element are each pivotable to become substantially vertical, and so that the vertical third brace element is positioned between and adjacent to the vertical second brace element of the same subassembly and a respective rear leg.

9. The folding chair of claim 1, wherein the first subassembly and second subassembly each comprise a scissor subassembly.

10. A folding chair, comprising:

a first subassembly comprising a first set of brace elements connected to a second subassembly comprising a second set of brace elements, each set of brace elements having a first brace element, a second brace element and a third brace element, each brace element having a first end and a second end, wherein for each subassembly, the first brace element is positioned interior of the second brace element and the third brace element of a same subassembly;

a cross-brace rigidly connecting the first brace element of the first subassembly with the first brace element of the second subassembly, the first subassembly and second subassembly being spaced apart from one another, wherein the cross-brace maintains alignment of the first and second subassemblies in relation to one another, and resists twisting and binding of the subassemblies;

a pair of front legs with a front cross-brace connected therebetween, and a pair of rear legs; and a frame configured to receive a seat, and connected to each of the legs, wherein the first end of each first brace element rotatably connects to the front cross-brace at a point spaced apart from a nearest leg, and the second end of each first brace element rotatably connects with a second brace element of a same subassembly, and wherein a first end of each second brace element rotatably connects to the frame and the second end of each second brace element rotatably connects to a respective one of the pair of rear legs, and wherein a first end of each third brace element rotatably connects to a respective one of the pair of rear legs and a second end of each third cross-brace element rotatably connects to the first brace element of a same subassembly, and wherein the first subassembly and second subassembly are configured to expand or collapse thereby permitting the folding chair to expand to an open position or collapse to a closed position.

11. The folding chair of claim 10, wherein the first end of each third brace element rotatably connects to a respective one of the pair of rear legs at a point lower than a point where the second end of each second brace element rotatably connects to the same respective one of the pair of rear legs.

12. The folding chair of claim 10, wherein the cross-brace connects to each subassembly at a same corresponding point of each respective first brace element, and the second end of each third brace element rotatably connects to the first brace element of the same subassembly at a point between (a) the corresponding point and (b) a location where the first brace element rotatably connects with the second brace element of the same subassembly.

13. A folding chair, comprising:

a first subassembly comprising a first set of brace elements connected to a second subassembly comprising a second set of brace elements, each set of brace elements having a first brace element, a second brace element and a third brace element, each brace element having a first end and a second end;

a cross-brace rigidly connecting the first brace element of the first subassembly with the first brace element of the second subassembly, the first subassembly and second subassembly being spaced apart from one another, wherein the cross-brace maintains alignment of the first and second subassemblies in relation to one another, and resists twisting and binding of the subassemblies;

a pair of front legs with a front cross-brace connected therebetween, and a pair of rear legs; and a frame configured to receive a seat, and connected to each of the legs, wherein the first end of each first brace element rotatably connects to the front cross-brace at a point spaced apart from a nearest leg, and the second end of each first brace element rotatably connects with a second brace element of a same subassembly, and wherein a first end of each second brace element rotatably connects to the frame and the second end of each second brace element rotatably connects to a respective one of the pair of rear legs, and wherein a first end of each third brace element rotatably connects to a respective one of the pair of rear legs and a second end of each third cross-brace element rotatably connects to the first brace element of a same subassembly, and wherein the first subassembly and second subassembly are configured to expand or collapse thereby permitting the folding chair to expand to an open position or collapse to a closed position;

wherein the cross-brace connects to each subassembly at a same corresponding point of each respective first brace element, and the second end of each third brace element rotatably connects to the first brace element of the same subassembly at a point between (a) the corresponding point and (b) a bend proximate the second end of the first brace element.

14. The folding chair of claim 10, wherein the first end of each second brace element rotatably connects to the frame at about a midpoint between a front leg and a rear leg.

* * * * *